US007230613B1

(12) United States Patent
Steffensmeier et al.

(10) Patent No.: US 7,230,613 B1
(45) Date of Patent: Jun. 12, 2007

(54) DISPLAY DRIVER SUPPORTING A DIMMING MODE

(75) Inventors: Martin J. Steffensmeier, Cedar Rapids, IA (US); Thomas A. Seder, Roseville, MI (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 405 days.

(21) Appl. No.: 10/378,486

(22) Filed: Mar. 3, 2003

(51) Int. Cl.
*G09G 3/10* (2006.01)

(52) U.S. Cl. ..... 345/204; 345/87; 345/207; 345/690; 345/691; 315/291; 315/307; 315/308

(58) Field of Classification Search ..... 345/87, 345/204, 207, 690, 691; 315/169.3, 209 R, 315/291, 307, 308
See application file for complete search history.

(56) References Cited

U.S. PATENT DOCUMENTS 4,722,005 A * 1/1988 Ledenbach ..... 348/173
5,717,601 A * 2/1998 Farthing ..... 702/58
5,781,139 A * 7/1998 Weisbrod ..... 341/150
5,939,830 A * 8/1999 Praiswater ..... 315/169.3
6,091,201 A * 7/2000 Walsh et al. ..... 315/169.1
6,218,788 B1 * 4/2001 Chen et al. ..... 315/225
6,304,039 B1 * 10/2001 Appelberg et al. ..... 315/169.3
6,353,291 B1 * 3/2002 Borgogno et al. ..... 315/169.3
2002/0030647 A1 * 3/2002 Hack et al. ..... 345/82
2002/0063728 A1 * 5/2002 Stevens ..... 345/690
2002/0080106 A1 * 6/2002 Miwa et al. ..... 345/87
2002/0080127 A1 * 6/2002 Park et al. ..... 345/204
2002/0101169 A1 * 8/2002 Boer ..... 315/169.3
2003/0178951 A1 * 9/2003 Park et al. ..... 315/312
2003/0210216 A1 * 11/2003 Kim et al. ..... 345/87
2004/0155853 A1 * 8/2004 Lin ..... 345/102

* cited by examiner

*Primary Examiner*—Bipin Shalwala
*Assistant Examiner*—Vincent E. Kovalick
(74) *Attorney, Agent, or Firm*—Nathan O. Jensen; Kyle Eppele

(57) ABSTRACT

A visual display includes a dimming mode. The dimming mode is provided via analog and digital dimming mode signals. The dimming mode signals can be provided via a digital-to-analog converter. The display can be an OLED or LCD display used in avionic and projection applications.

3 Claims, 4 Drawing Sheets

DISPLAY DRIVER SUPPORTING A DIMMING MODE

FIELD OF THE INVENTION

The present invention relates generally to a display driver for a visual display. More particularly, the present invention relates to a display driver capable of operating in a dimming mode.

BACKGROUND OF THE INVENTION

Displays are utilized in diverse applications for which visual information is presented. Displays include conference room projectors, optical equipment, operator displays, computer displays, dashboard displays, cockpit displays, entertainment displays, etc. In general, it is desirous to provide large gray scale capability to displays. Gray scale capability refers to the range from darkness to lightness for each pixel or element on a display. More gray scale capability (e.g., more bits of gray scale) are particularly important in avionic display systems, projection displays and other high-definition viewing applications.

In conventional display systems, such as, liquid crystal display (LCD) systems, the brightness of each pixel or element is controlled by a transistor. The display includes a matrix of transistors, such as, thin film transistors (TFTs) arranged in rows and columns. Alternatively, the display can include other light controlling or light emitting devices arranged in a matrix.

A column line is coupled to the drain or source associated with each transistor in each column. A row line is coupled to each gate associated with the transistors in each row. A row of transistors is activated by providing a gate control signal to the row line. The gate control signal turns on each transistor in the row. Each transistor in the row provides an analog voltage associated with its column line to cause the pixel or element to emit a particular amount of light.

Generally, a column driver circuit provides the analog voltage to the column lines so that the appropriate amount of light is emitted by each pixel or element. In conventional systems, the column driver circuit can typically provide approximately 8 or 16 levels of voltage at the column line (approximately 8 or 16 gray scale levels).

Conventional displays such as flat-panel displays, liquid crystal displays (LCDs) and projection light sources are not readily dimmable. Certain conventional displays have provided dimming modes by adjusting the amount of light emitted by a spacial light modulator by adjusting the light source. For conventional projection applications spacial light modulators can be of the type manufactured by Texas Instruments, such as, digital micromirror displays and digital light processors.

According to one type of conventional projection display, a conference room projector, the projector includes an arc lamp as its background or projection light source. The arc lamp is difficult to effectively dim. The power provided to the arc lamp is decreased to dim the display. However, reducing the power to the arc lamp can severely shorten the operational life of the arc lamp.

Further, conventional dimming schemes have not achieved a wide dimming range. Reducing the available gray scale range for the display when it is in the dimming mode is not an acceptable option for display customers.

There is a need for a display system or projection system including a dimming mode for some applications, such as avionics. Further still, there is a need for a display system or projection system including a dimming mode with does not compromise gray scale capabilities or lamp lifetime. Yet even further still, there is a need for a projection system or display system having a dimming mode which does not jeopardize the lifetime of background light sources.

SUMMARY OF THE INVENTION

An exemplary embodiment relates to a display operable in a dimming mode. The display comprises an array of devices for receiving gray scale signals, a column driver circuit for providing the gray scale signals, and a dimming mode circuit for providing dimming signals. The dimming signals are provided to the devices. The devices provide light in accordance with the dimming signals and the gray scales signals.

Yet another exemplary embodiment relates to a display circuit for a visual display having an array of elements arranged in at least a first row, a second row, a first column and a second column. The display circuit comprises a first means for providing at least a first gray scale signal to the elements and a second means for providing at least first dimming signal to the elements.

Still another exemplary embodiment relates to a method of achieving a dimming mode for a display. The method comprises providing a gray scale digital signal representative of a gray scale analog voltage signal, converting the gray scale digital signal to the gray scale analog voltage signal, providing a dimming digital signal representative of a dimming voltage signal, and converting the dimming digital signal to the dimming analog voltage signal. The method further comprises providing the gray scale analog voltage signal and the dimming analog voltage signal to an element of the display.

BRIEF DESCRIPTION OF THE DRAWINGS

The present invention will hereafter be described with reference to the accompanying drawings, wherein like numerals denote like elements and.

DETAILED DESCRIPTION OF THE PREFERRED EMBODIMENTS

Figure 1:
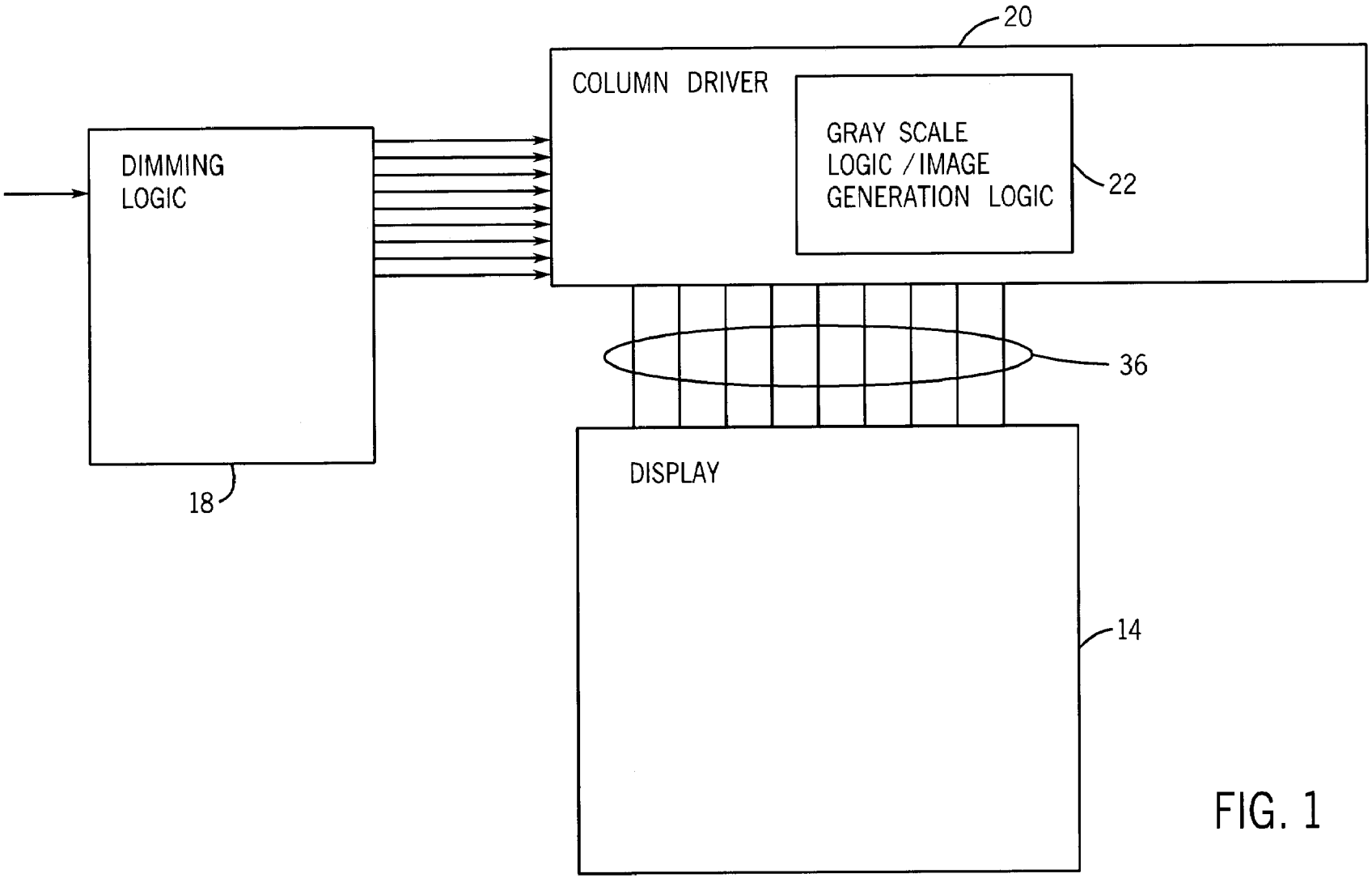
FIG. 1 is an exemplary block diagram of a visual display system operable with a dimming mode circuit in accordance with an exemplary embodiment.

With reference to FIG. 1, a display system 10, such as, a liquid crystal display (LCD), organic liquid crystal display (OLED) display, or MEMs-based on spatial light modulation includes a display 14. System 10 can also include a dimming logic and driver circuit 18, a column driver circuit 20, and a gray scale logic circuit 22. Column driver circuit 20 and gray scale logic circuit 22 provide electronic signals (gray scale analog voltage signals) which cause display 14 to provide visual indicia. The visual indicia can include dynamic or static images.

System 10 can advantageously operate in one or more dimming modes. In an exemplary embodiment, system 10 can operate in more than 254 different dimming modes. In another alternative embodiment, system 10 operates in a single dimming mode (one dimming level) and a non-dimming mode (normal operation). In still another alternative embodiment, system 10 operates in four dimming modes. Dimming logic and driver circuit 18 provides signals to display 14 to implement the at least one dimming mode.

Display 14 is preferably a color-twisted nematic LCD having 640×480, 1024×768, or 1280×1024 pixels. Each pixel can be comprised of three LCD elements, one for each primary color (e.g., red, green, and blue). Display 14 can be a normally white or a normally black display.

Display 14 preferably includes an array of transistors, such as, thin film transistors (TFTs), provided over an LCD cell. The array of transistors is utilized to manipulate liquid crystals in display 14 to appropriately cause colors and/or gray levels to be provided on display 14. Single crystal transistors can be used if a Lighted Crystal on Silicon (LCoS) display is utilized. Alternatively, display 14 can include an array of other electronic devices, such as, light emitting diodes (LEDs), organic LEDs or other devices. The type of display 14 is not described in a limiting fashion.

The transistors or elements are arranged in rows and columns. The transistors have one drain/source coupled to a liquid crystal display cell and the other drain/source coupled to a column conductor or line 36. The gate of the transistors are coupled to row lines. Column lines 36 are coupled to column driver circuit 20. When a row is turned "ON", voltages from column lines 36 are provided to the liquid crystal display cell. Depending upon the magnitude of the voltage on column line 36, the pixel or element associated with the transistor in the selected row and the selected column emits a certain level of light.

Column driver circuit 20 ensures that the proper LCD elements emit the proper amount of light to create the visual indicia. For example, column driver circuit 20 can provide voltage signals from zero to five volts at any number of voltage levels. Generally, the larger the number of different voltage levels, the greater the number of different levels of light (gray scales) that can be provided from the LCD element. In another embodiment, column driver circuit 20 provides voltage signals from 0 to 3.3 V.

Gray scale logic circuit, or image generator logic 22 can be part of column driver circuit 20 and provides the digital signal representative of the selected gray scale for column driver circuit 20. Gray scale logic circuit 22 can be implemented as an ASIC, a processor, or any device for providing digital signals representative of a gray scale level to column driver circuit 20. Various algorithms and techniques can be used to generate digital gray scale signals for column driver circuit 20.

Column driver circuit 20, gray scale logic circuit 22 and display 14 are not described in a limiting fashion. Gray scale logic circuit 22, column driver circuit 20 and display 14 can be replaced with any conventional system. Display 14, gray scale logic circuit 22 and column driver circuit 20 can be replaced by any devices which provide visual indicia in accordance with gray scale levels. For example, display 14 can be a projection display, an avionic display, an operator display, or any device for providing visual or static images. Similarly, column driver circuit 20 and gray scale logic circuit 22 can be implemented in a variety of fashions. In one embodiment, column driver circuit 20, gray scale logic circuit 22 and dimming logic and driver circuit 18 can be combined as one circuit or as two circuits.

Dimming logic and driver circuit 18 provides a dimming analog voltage signal to column driver circuit 20 so column driver circuit 20 can in turn provide the appropriate analog signal to column lines 36A-C to provide a dimming effect.

Figure 2:
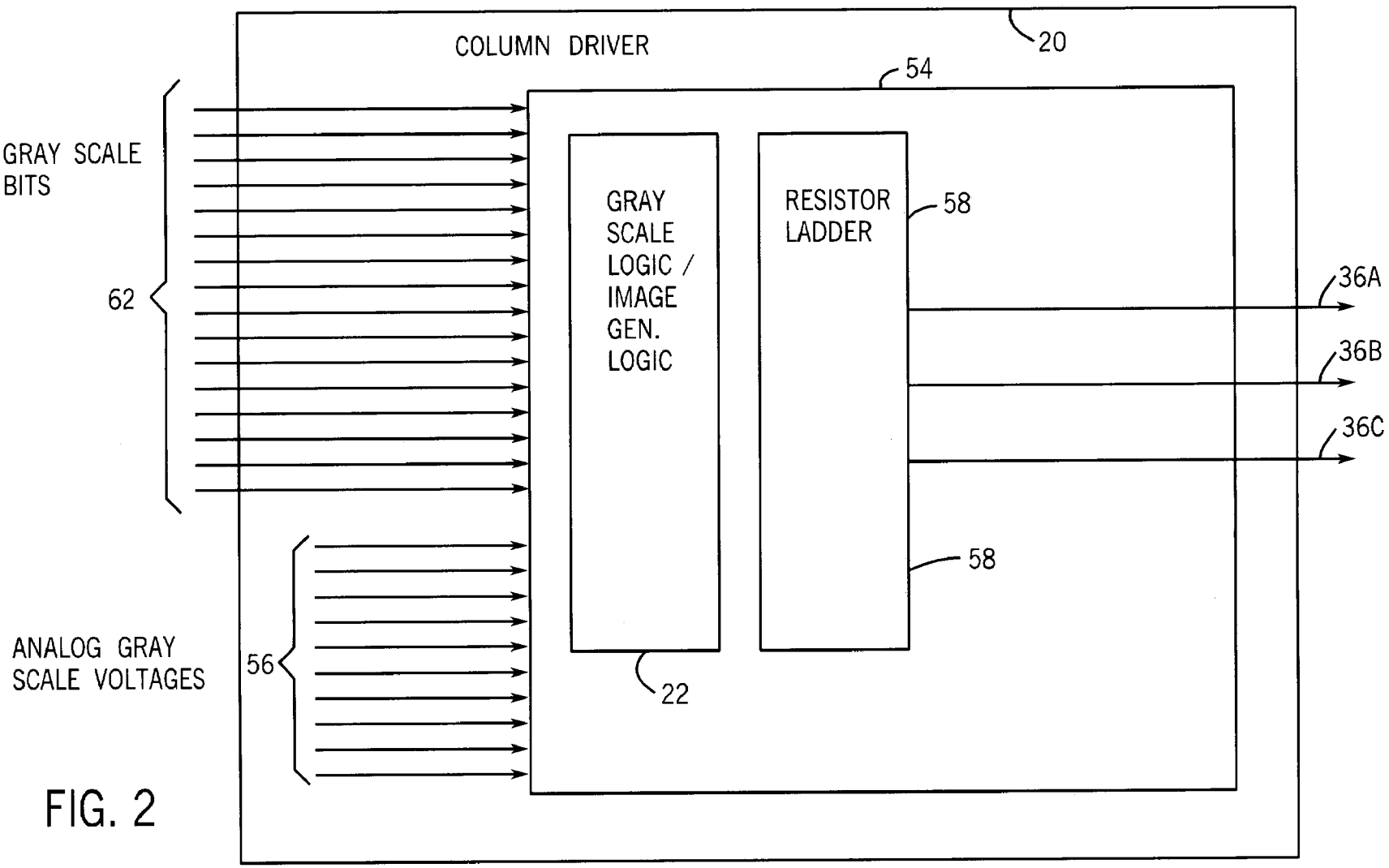
FIG. 2 is a more detailed block diagram of a column driver circuit for the system illustrated in FIG. 1.

With reference to FIG. 2, column driver circuit 20 includes a digital-to-analog converter 54. Digital-to-analog converter 54 receives analog gray scale voltages at inputs 56 that are provided to a resistive ladder circuit 58. Digital gray scale bits from gray scale logic circuit 22 are provided to column driver circuit 20 which control switches within column driver circuit 20. Accordingly, bits provided at input 62 control the voltage provided at lines 36.

As shown in FIG. 2, digital to analog converter 54 provides a red signal at a column line 36A, a blue signal on a column line 36B and a yellow signal on a column line 36C. Inputs 62 can include 8 bits for a red color input, 8 bits for a blue color input, and 8 bits for a yellow color input.

Alternatively, other color choices can be represented. The number of bits and the number of gray scale voltage levels shown in FIG. 2 are provided as examples only. Any number of bits and voltage levels can be utilized to provide appropriate gray scale analog voltage signals to column lines 36. Further, other types of digital-to-analog converting devices can be utilized including analog memory units, buffers, etc.

Figure 3:
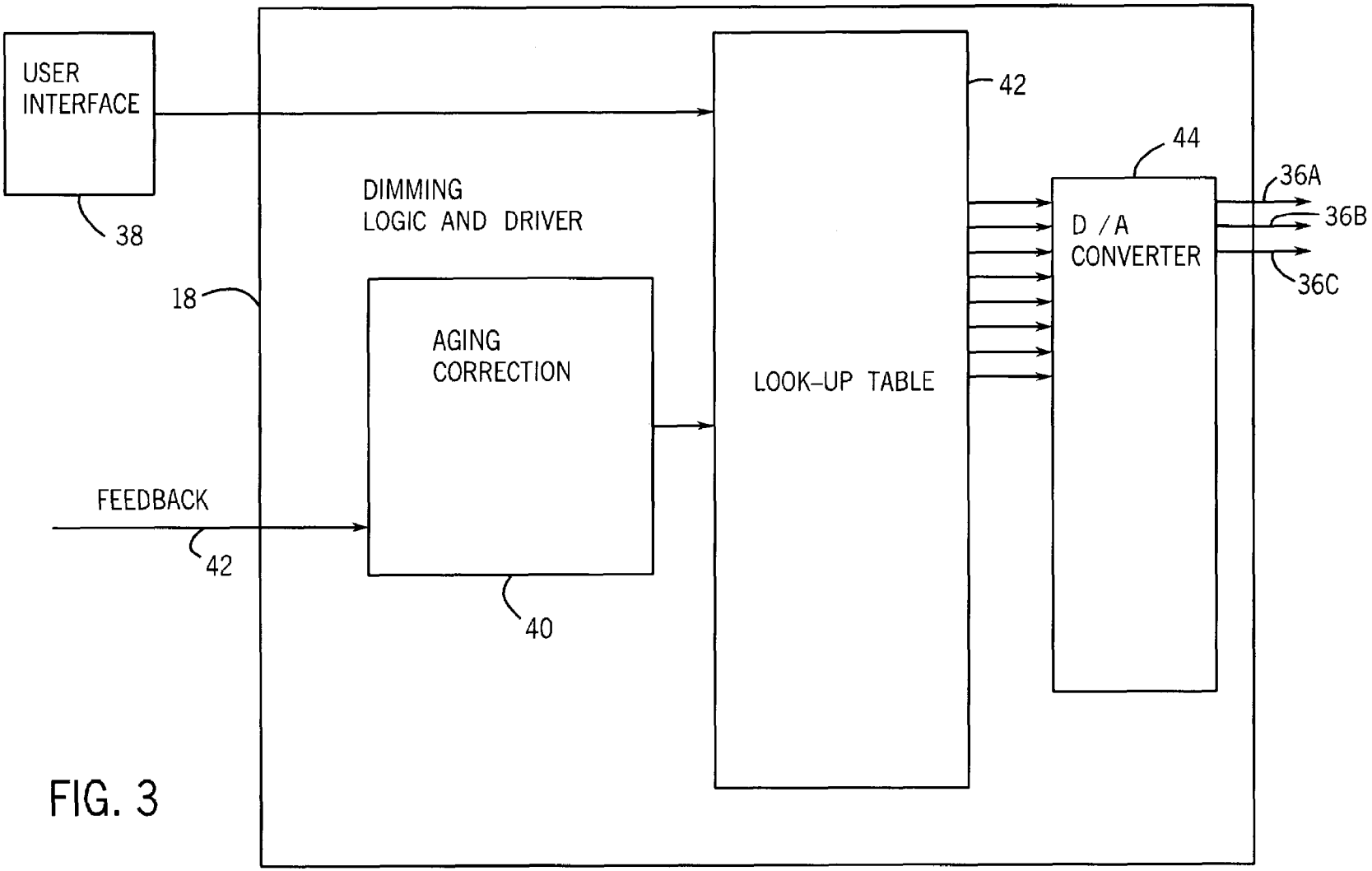
FIG. 3 is a more detailed block diagram of a dimming logic and driver circuit for the system illustrated in FIG. 1, in accordance with another exemplary embodiment.

With reference to FIG. 3, dimming and logic driver circuit 18 can be coupled to a user interface 38 through which an operator or user can adjust a dimming level or engage a dimming mode for system 10. User interface 38 can be a dial, a switch, a software interface, or any apparatus for providing an indication of dimming level to system 10. In one embodiment, interface 38 includes a dial providing an analog or digital signal representing 1, 4 or 256 different dimming mode levels.

Dimming and logic driver circuit 18 can include an aging correction circuit 40, a lookup table 42, and a digital-to-analog converter 44. Digital-to-analog converter 44 can be similar to digital-to-analog converter 54 discussed with reference to FIG. 2. Any apparatus can be utilized to provide the dimming analog signal at column lines 36A, 36B and 36C. As discussed with reference to FIG. 2, each of column lines 36A, 36B and 36C can be utilized for a unique color.

With reference to FIGS. 1-3, the operation of system 10 including a dimming mode is described. According to one exemplary embodiment, an operator can select a dimming level though user interface 38 which is provided to lookup table 42. Lookup table 42 provides a digital dimming signal to digital-to-analog converter 44 representative of the dimming level selected at user interface 38. The digital dimming signal can be an eight bit signal.

Converter 44 converts the digital representation of the dimming level to a dimming analog voltage signal at outputs 36A, 36B, and 36C. The dimming analog voltage signal is combined with the gray scale analog voltage signal at column lines 36A, 36B and 36C and provided to display 14.

According to another exemplary embodiment, an aging correction circuit 40 can provide an adjustment to the dimming analog voltage signal through lookup table 42. Aging correction circuit 40 can include data stored as a result of empirical data. The data represents aging characteristics associated with display 14. In this way, the analog voltage signal provided at column lines 36A, 36B, and 36C can be adjusted to accommodate degradation of display 14 over time.

Aging correction circuit 40 can be an ASIC, a lookup table, a processor or other device for providing aging data or operating aging algorithms. In another embodiment, aging correction circuit 40 receives a feedback signal at input 42 representative of the operational capabilities of display 14. The feedback signal can be provided by an optical sensor associated with the back light utilized by display 14 or by a voltage or current sensor associated with a power supply for the back light. The feedback signal preferably represents the degradation of the back light.

Aging correction circuit 40 can make adjustments based upon the perceived degradation of the back light from the signal at input 42. Therefore, dimming and logic driver circuit 18 can advantageously compensate for degradation due to aging either of display 14 or a background light for display 14.

Figure 4:
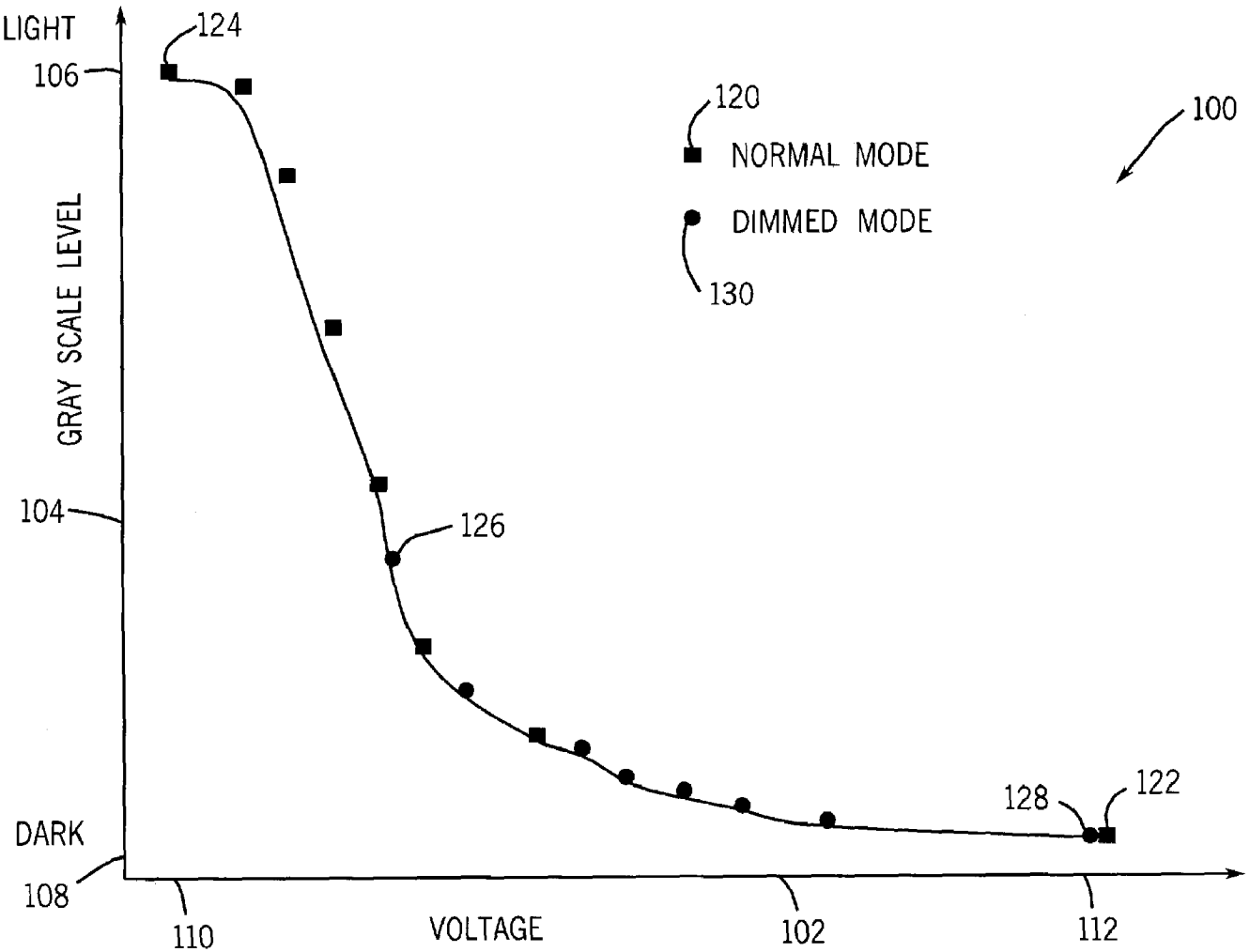
FIG. 4 is a graphical representation of gray scale levels for the system illustrated in FIG. 1 for the normal mode and the dimming mode, in accordance with still another exemplary embodiment of the present invention.

With reference to FIG. 4, a graph 100 includes an X-axis 102 representing analog voltage provided at column line 36 and a Y-axis 104 representing a gray scale level or brightness having a top 106 representing lightness and a bottom 108 representing darkness. Axis 102 has a left side 110 representing low voltage and a right side 112 representing high voltage. Alternatively, the orientation of either of axes 102 or 104 can be reversed depending upon design of display 14. Gray levels typically can represent discrete brightness levels. Brightness is generally continuous.

Operation of display 14 in a normal mode (e.g., a non-dimming mode), is represented by square shaped references 120. As shown, gray scale levels vary greatly from a black gray scale level 122 to a light gray scale level (almost white) 124. In a dimmed mode, gray scale levels are represented by circular references 130. In the dimmed mode, gray scale levels vary from a mid brightness level 126 to an almost black brightness level 128. As shown in FIG. 4, system 10 has eight different gray scale levels whether in the normal mode or the dimmed mode.

It is understood that, while the detailed drawings, specific examples, and particular component values given describe preferred exemplary embodiments of the present invention, they are for the purpose of illustration only. The apparatus and method of the present invention are not limited to the precise details and conditions disclosed. Single lines in the drawings can represent multiple conductors. For example, although an analog generation circuit including a digital-to-analog converter is discussed, other types of analog generation circuits can be provided. Yet further, although a color display is described, a monochrome display can be utilized. Changes may be made to the details disclosed without departing from the spirit of the invention, which will be defined by the following claims.

What is claimed is:

1. A display operable in a dimming mode, the display comprising:

an array of devices for receiving gray scale signals;

a column driver circuit for providing the gray scale signals; and a dimming mode circuit for providing dimming signals to the devices, wherein the devices provide light in accordance with the dimming signals and the gray scale signals, wherein the dimming mode circuit provides the dimming signals to compensate for aging in the display.

2. The display of claim 1, wherein the dimming signals include a first color dimming signal, a second color dimming signal and a third color dimming signal.

3. A method of achieving a dimming mode for a display, the method comprising:

providing a gray scale digital signal representative of a gray scale analog voltage signal;

converting the gray scale digital signal to the gray scale analog voltage signal;

providing a dimming digital signal representative of a dimming voltage signal;

converting the dimming digital signal to the dimming analog voltage signal; and providing the gray scale analog voltage signal and the dimming analog voltage signal to an element of the display, wherein the dimming digital signal is provided in accordance with an aging algorithm.

* * * * *